US006641135B1

(12) United States Patent
Weinheimer

(10) Patent No.: US 6,641,135 B1
(45) Date of Patent: Nov. 4, 2003

(54) DEVICE FOR STORING AND ISSUING SHEET-LIKE MATERIAL, IN PARTICULAR, BANK NOTES, AND A GUIDE UNIT AND A TRANSPORT UNIT FOR SAID DEVICE

(75) Inventor: Alfred Weinheimer, Oberheimbach (DE)

(73) Assignee: Löwen Automaten Gerhard W. Schulze GmbH, Bingen am Rhein (DE)

( * ) Notice: Subject to any disclaimer, the term of this patent is extended or adjusted under 35 U.S.C. 154(b) by 0 days.

(21) Appl. No.: 09/807,549

(22) PCT Filed: Dec. 28, 1999

(86) PCT No.: PCT/EP99/10426

§ 371 (c)(1),
(2), (4) Date: Jul. 18, 2001

(87) PCT Pub. No.: WO00/42579

PCT Pub. Date: Jul. 20, 2000

(30) Foreign Application Priority Data

Jan. 18, 1999 (DE) ..... 199 01 764
Aug. 3, 1999 (DE) ..... 199 36 416

(51) Int. Cl.[7] ..... B65H 39/10
(52) U.S. Cl. ..... 271/287; 271/292; 271/294
(58) Field of Search ..... 271/3.01, 3.14, 271/163, 279, 287, 292, 294; 232/7, 12, 15, 16

(56) References Cited

U.S. PATENT DOCUMENTS

| | | | |
|---|---|---|---|
| 3,608,690 A | | 9/1971 | Morrow et al. |
| 4,145,037 A | | 3/1979 | Mol |
| 4,547,058 A | * | 10/1985 | Peffer |
| 4,781,371 A | * | 11/1988 | Stemmle |
| 4,807,736 A | | 2/1989 | Kondo et al. |
| 5,076,413 A | | 12/1991 | Davila et al. |

FOREIGN PATENT DOCUMENTS

| | | |
|---|---|---|
| DE | 4005291 | 8/1990 |
| DE | 4240929 | 6/1994 |
| DE | 19810542 | 3/1998 |
| DE | 19842267 | 9/1999 |
| GB | 2236143 | 3/1991 |

* cited by examiner

*Primary Examiner*—David H. Bollinger
(74) *Attorney, Agent, or Firm*—Dilworth & Barrese LLP.

(57) ABSTRACT

The invention relates to an apparatus for the storage and/or dispensing of sheet-like material, in particular bank notes 23, comprising a compartment module (10) having a plurality of compartments (11), a slider (6) which can be travelled into and out of a compartment (11) so that a sheet-like material (23) lying in front of an opening (11*a*) of the compartment (11) can be inserted into and/or dispensed from the compartment (11) while being folded; and a guide device (3) which is displaceable between two positions, with in the first position the sheet-like material (23) being able to be introduced into the guide device (3) and the opening (11*a*) of the compartment (11) being blocked, and in the second position the opening (11*a*) of the compartment (11) being free so that the sheet-like material (23) can be inserted into the compartment (11); and a guide device for sheet-like material (23), in particular bank notes, comprising a first guide plane (3*a*); a second guide plane (3*b*), which is opposite the first guide plane (3*a*) so that a guide gap is formed therebetween; a feed aperture (3*d*) at one side of the first and second guide planes (3*a*, 3*b*); and at least one coupling element (3*c*) for the engagement of a movement apparatus for the guide device (3); and a conveyor device for sheet-like material (23), in particular bank notes, comprising a first guide metal sheet (16); and a movable belt (20) which can be moved along the surface of the first guide metal sheet (16) so that the sheet-like material (23) can be transported between the first guide metal sheet (16) and the movable belt (20).

20 Claims, 9 Drawing Sheets

DEVICE FOR STORING AND ISSUING SHEET-LIKE MATERIAL, IN PARTICULAR, BANK NOTES, AND A GUIDE UNIT AND A TRANSPORT UNIT FOR SAID DEVICE

BACKGROUND OF THE INVENTION

The invention relates to an apparatus for the storage and dispensing of sheet-like material, in particular bank notes, and to a guide device and a conveyor device for this apparatus.

Apparatuses for the storage and dispensing of bank notes are known, for example, in the form of the cash dispensers operated by banks which dispense requested monetary amounts within the existing credit limit after the insertion of credit or cheque cards and after entering a PIN number. Such cash dispensers are, however, very complex with respect to their design.

With gambling machines, for example, there is a need to pay out monetary amounts of some 100 deutschmarks after winning as part of a special game series; this is currently generally done by paying out coins. However, to avoid the pay-out of a large number of coins, there is a need to pay out large amounts using bank notes from gambling machines, too, particularly if the gambling machines are also designed to accept notes to deposit the game credit. However, only those apparatuses for the dispensing of bank notes can be considered for gambling machines which can be manufactured at a favourable cost.

SUMMARY OF THE INVENTION

It is therefore the object of the invention to provide an apparatus of the type first given which is characterised by a simple and economically performable construction and which simultaneously ensures a reliable conveying of the bank notes, and to provide a guide device and a conveyor device for the apparatus.

The object is solved by the features of the invention. Advantageous embodiments can be seen herein.

The apparatus in accordance with the invention for the storage and dispensing of sheet-like material, in particular bank notes, has a compartment module in which a plurality of individual compartments are arranged, with a slider being provided which can be moved into and out of a compartment. Both a slider for the whole apparatus or a slider for every compartment can be provided. A sheet-like material, which is positioned in front of an opening of a compartment, can be pushed into the compartment by the slider while being folded and pushed out of the compartment again. Furthermore, a guide device is provided which can be displaced between two positions, with the guide device being designed so that in a first position, the sheet-like material can be introduced into the guide device and the opening of the compartment into which the sheet-like material is to be introduced is blocked by the guide device. The guide device can be brought into a second position so that the opening of the compartment becomes free, whereupon the sheet-like material can be introduced with the slider. A safe and reliable guiding of the sheet-like material or bank note can thus be ensured by the guide device, such as, for example, a guiding in the feed plane of the bank note in front of the opening of the compartment. An erroneous escaping to the side of the bank note can be prevented by the guide device. The bank note reaching the point of intersection between, for example, the horizontal direction of introduction of the bank note into the compartment and, for example, the perpendicular feed plane can no longer be erroneously guided into the now blocked opening of the compartment due to the guide device so that the bank note is reliably guided into the desired feed plane. This point of intersection between the direction of introduction into the compartment and the feed direction of the bank note can reliably be crossed by the bank note with the guide device so that the bank note is reliably forwarded at this point of intersection. After the bank note has ended its feed movement, the guide device is brought into the second position, in which the opening of the compartment is free, so that the bank note can be introduced into the compartment by the slider.

As already stated, it is possible to provide every single compartment with a slider so that advantageously the slider of the respective compartment is only moved when a bank note is to be inserted or taken out. It is alternatively also feasible to provide a single slider in the apparatus with which bank notes can be introduced into or taken out of the individual compartments. In this process, either the slider can be moved along the individual compartments of the compartment module or the compartment module can be moved past the slider.

Preferably, a conveyor device is provided for the feeding of the sheet-like material at the apparatus for the storage and dispensing of sheet-like material with which the sheet-like material or a bank note is fed from an insertion opening of the guide device, with advantageously a test apparatus for the bank note being provided.

A lever is advantageously provided which is coupled to the guide device and the slider so that the slider engages into the lever when moving out or in its position moved out of the compartment, whereby the lever is pivoted out of its rest position, with the guide device also being displaced via the coupling of the lever to the guide device so that the opening of the compartment is blocked by the guide device. When the slider is moved in to introduce a bank note into the compartment, the lever is pivoted back into its rest position so that the guide device releases the opening of the compartment again.

The lever is advantageously biased in its rest position by a spring, with the opening of the compartment being released by the guide device.

Drive elements can be provided for the slider, the guide device, the lever and the conveyor device or only for individual elements thereof, which ensure the desired procedure in the introduction of the sheet-like material into the compartment. Suitable detectors can be provided here for the control of the respective drive which detect individual elements at certain positions, such as the slider in the waiting position or a conveyed bank note shortly before reaching the crossover point of feed plane and the direction of introduction into the compartment. Suitable detectors can be, for example, light barriers or end switches, which emit desired signals on contact with a bank note, the slider or other moving parts of the apparatus.

The compartment module is advantageously designed to be displaceable, with a controlled drive being able to be provided to displace the compartment module.

The slider or the actuating apparatus for the slider is advantageously designed such that the slider is displaceable from the pushed in position in the compartment further into a dispensing position in order to dispense a bank note lying in the compartment.

In this process, a dispensing device can be provided at the dispensing side of the compartment, which is advantageously opposite the insertion side, which can take up the bank note and transport it onwards. The dispensing device can advantageously be formed by a roll pair between which the bank note to be dispensed is transported. Subsequent to the roll pair, the bank note can be transported onwards by, for example, a suitable belt conveyor apparatus.

The slider is advantageously formed as a planar plate which has one or more recesses in order to move past the dispensing device, in particular the roll pair. In this way, a reliable guiding of the bank note to be dispensed into the dispensing device can be realised.

The guide device for sheet-like material, in particular bank notes, in accordance with the invention has a first guide plane and a second guide plane which are opposite one another so that a guide gap for the sheet-like material is formed therebetween. A feed opening is formed at one side of the opposite guide planes into which the sheet-like material can be introduced. An outlet opening can be provided opposite the feed opening at the other side of the opposite guide planes and the guided sheet-like material can exit from this. It is, however, not absolutely necessary for the guided sheet-like material to exit at the outlet opening. If the opposite guide planes are long enough in the feed direction, then the total introduced sheet-like material is guided in the guide gap. At least one coupling element is provided at the guide device which is suitable for an engagement of a movement apparatus for the guide device. The guide device can be moved between desired positions via this coupling element so that, for example, one of the guide planes of the guide device comes to rest in front of a crossover point at which the fed sheet-like material could easily escape from the desired path without a guide device.

A feed apparatus is advantageously provided at the feed opening which can represent an opening tapering in the direction of the feed opening of the opposite guide planes. This feed apparatus can, for example, take on the function of a funnel so that a sheet-like material to be introduced can be introduced reliably into the guide gap between the guide planes.

The feed apparatus is preferably formed by pair-wise opposite elements at the first or second guide plane which can be formed, for example, as fork-like tongues.

The at least one coupling element of the guide device is preferably formed by recesses which can be arranged at the sides of one or both guide planes. A suitable movement device, such as a lever for example, can then engage into these recesses in order to move the guide device.

In accordance with the invention, the guide device for sheet-like material is used in an apparatus for the storage or dispensing of sheet-like material.

The conveyor device for sheet-like material, in particular bank notes, in accordance with the invention has a first guide metal sheet at which a sheet-like material—termed a bank note by way of example in the following—can be conveyed. At least one moving belt extends along the first guide metal sheet and can be moved on an upper or lower side of the guide metal sheet along its surface so that the sheet-like material can be transported in the intermediate space between the guide metal sheet and the belt. It is also possible to provide only two adjacent moving belts for the transport of the sheet-like material therebetween.

A second guide metal sheet is advantageously provided opposite the first guide metal sheet so that the sheet-like material to be transported can be reliably transported by the moving belt between the first and second guide metal sheets.

The moving belt is preferably formed as an endless belt and guided via a pulley block, with this pulley block being able to be pivoted such that a pressure force can be generated between the belt and the first guide metal sheet for the sheet-like material to be transported, whereby this can be reliably transported.

BRIEF DESCRIPTION OF THE DRAWINGS

A guide element can advantageously be provided to generate a pressure force between the guided sheet-like material and the moving belt so that, for example via the pressure of a spring or the inherent weight of the guide element, the sheet-like material is pressed onto the moving belt in order to be reliably taking along thereby.

The invention is described below by way of preferred embodiments. There are shown:

FIG. 1 shows a first embodiment of an apparatus for the storage and/or dispensing of sheet-like material, in particular bank notes, with the guide element or block element in accordance with the invention in a release position. A bank note 23 is inserted into the device, for example via a slit, at the upper end of the apparatus. The bank note 23 is inserted into the conveyor device 1 between guide metal plates 15 and 16, with the upper guide metal plate 16 being bent up at the entrance opening in order to simplify the introduction of the bank note 23. Cut-outs are provided in the lower guide metal sheet 15 into which conveyor rolls 7 and 8 protrude, via which a belt 20 is guided. A guide element 22 is provided at the conveyor device 1 and this can engage into the upper guide metal sheet 16 via recesses and which is biased by a spring 21 such that a pressure force is created in the direction of the belt 20. The guide element 22 engages in the representation shown via recesses into the guide metal sheets 15 and 16 so that a bank note 23 lying on the belt 20 and guided past the recesses presses the guide element 22 upwardly against the force of the spring 21 and is thus held by the guide element 22 on the belt 20 by a counter-pressure, whereby a defined pressure force can be generated between the bank note 23 and the belt 20. This is shown in FIG. 2 for the front end of the bank note 23. It is also possible to design the lower conveyor roll 8 in a pivotable manner so that this is pressed, for example biased by a spring force, in the direction of the upper guide metal sheet 16 in order to generate the desired pressure force between the bank note 23 and the belt 20.

Figure 1:
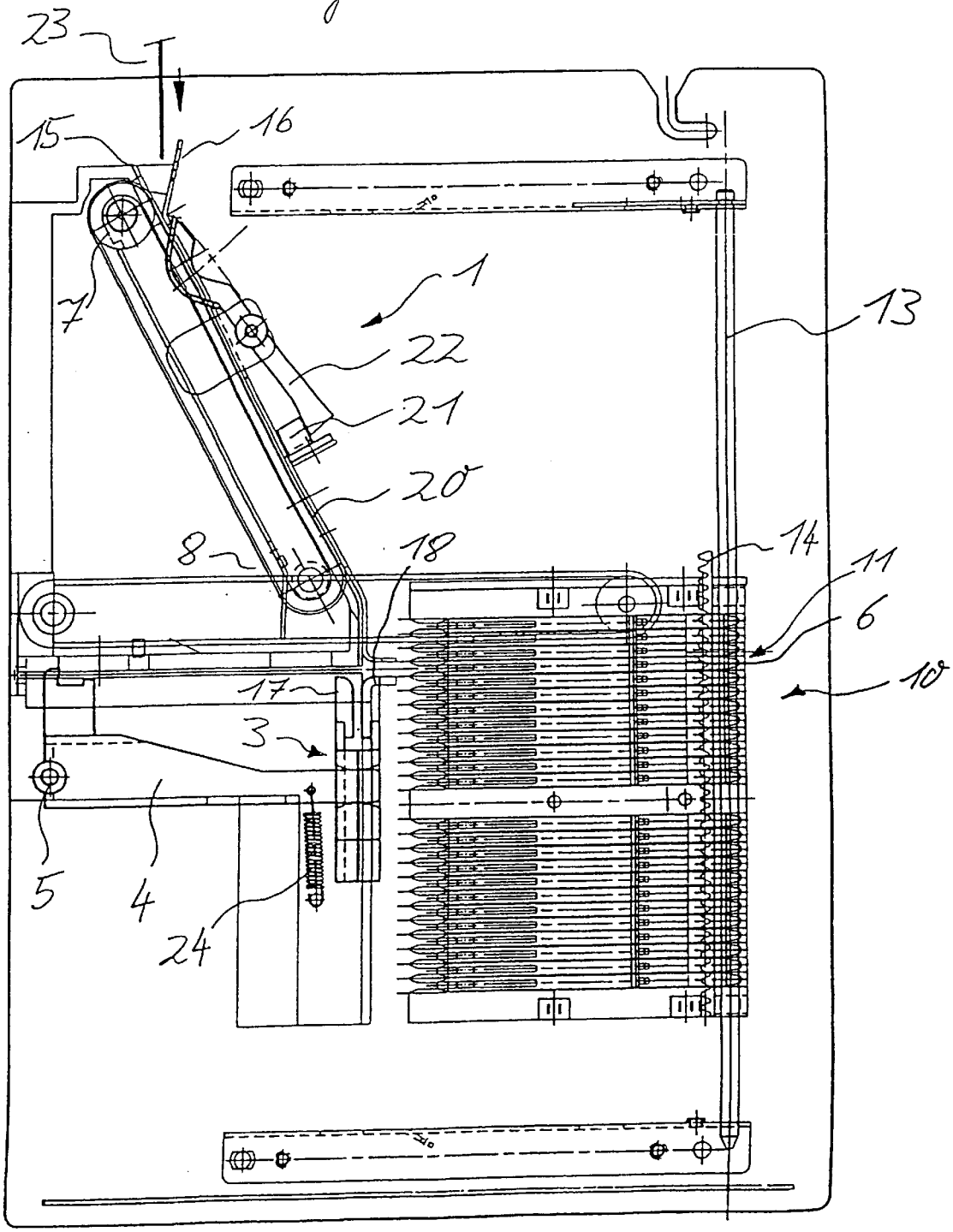
FIG. 1 the apparatus in accordance with the invention in accordance with a first embodiment of the invention for the storage or dispensing of sheet-like material with a bank note in the insertion position.

The compartment module 10 with a plurality of compartments 11 parallel to one another is arranged in the region of the lower end of the conveyor device 1. This compartment module 10 can be guided vertical at a rod system 13 and can be displaced into a desired position via the rack 14. In each compartment 11 of the compartment module 10, sword-like sliders 6 are provided which are all located in the retracted position in FIG. 1.

Figure 2:
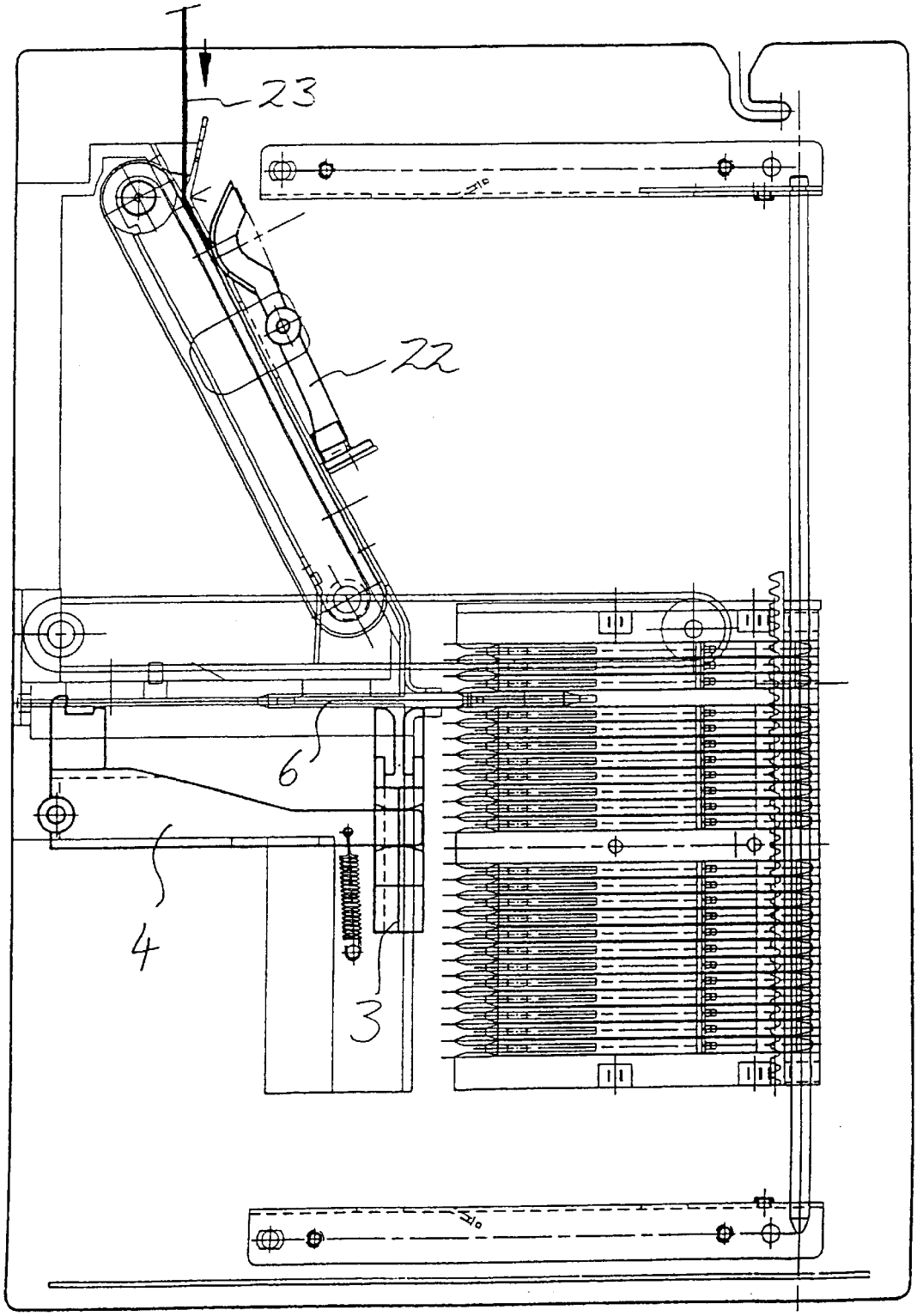
FIG. 2 the apparatus of FIG. 1 with a bank note inserted further onwards and a slider in a half-extended position.

FIG. 2 shows that a slider 6 is moved out of a compartment 11 by a dog not shown in any further detail and passes by the upper end of the guide element 3.

DESCRIPTION OF THE PREFERRED EMBODIMENTS

Figure 3:
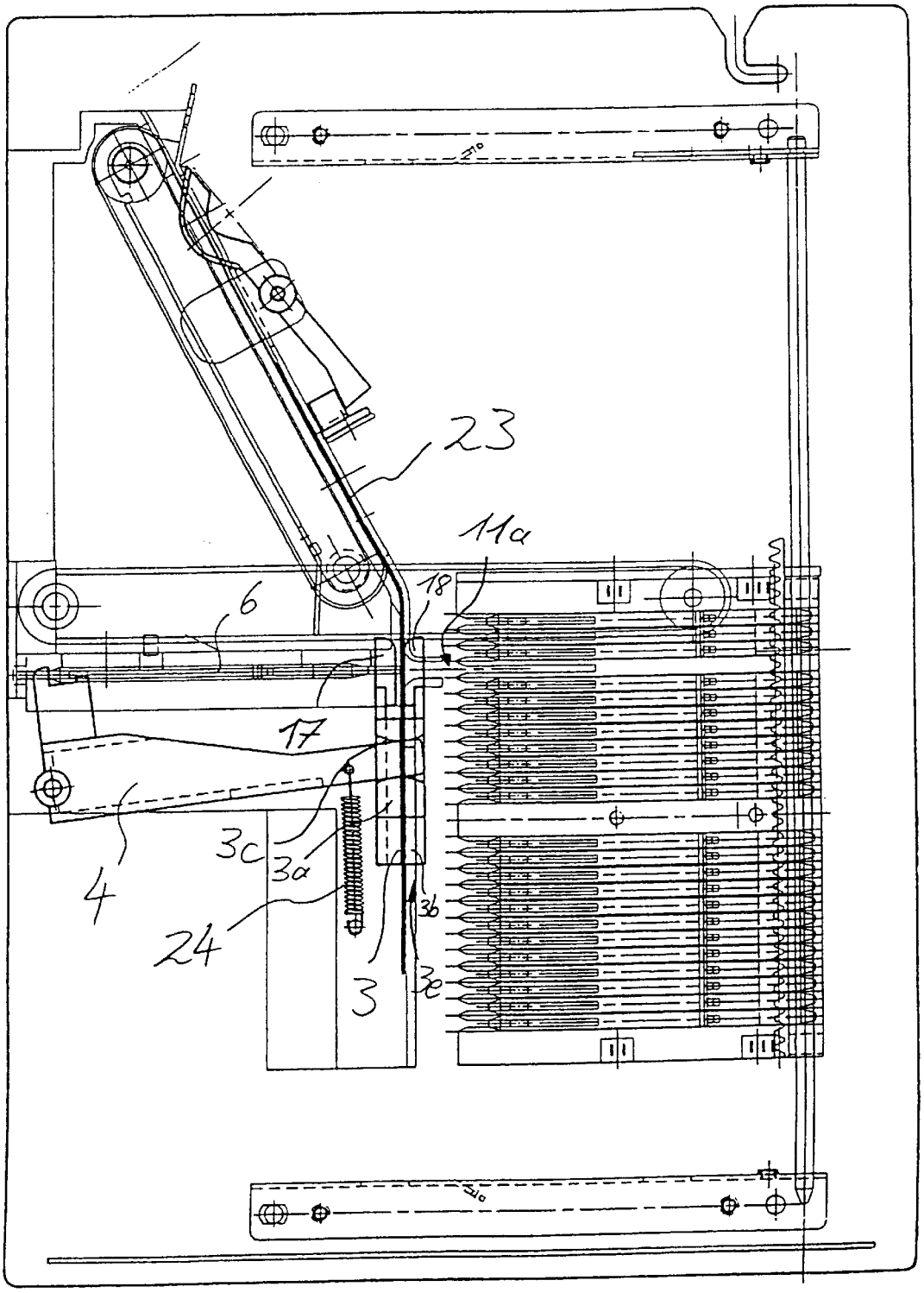
FIG. 3 the apparatus of FIG. 1 with a slider in the fully extended position and a guide device in the blocked position through which the bank note was guided.

As can be seen from FIG. 3, the slider has been moved into its most extreme position and contacts a contact edge of the lever 4 which moves the guide element into the blocking position via the engagement 3*c* of the guide element 3 so that the opening 11*a* of the compartment is blocked. This pivot movement of the lever 4 takes place against the tensile force of the spring 24 which biases the lever 4 in its rest position. The bank note 23 can be reliably introduced between the guide planes 3*a* and 3*b* of the guide element at the upper end of the guide element 3 via the fork-like tongues 17 and 18 and exits the guide element 3 again at the outlet opening 3*e*, with the crossover point of the vertical feed direction of the bank note 23 and the horizontal insertion direction into the compartment 11 via the slider 6 being reliably formed by way of the guide device 3 such that an erroneous side escape of the bank note 23 is excluded.

Figure 4:
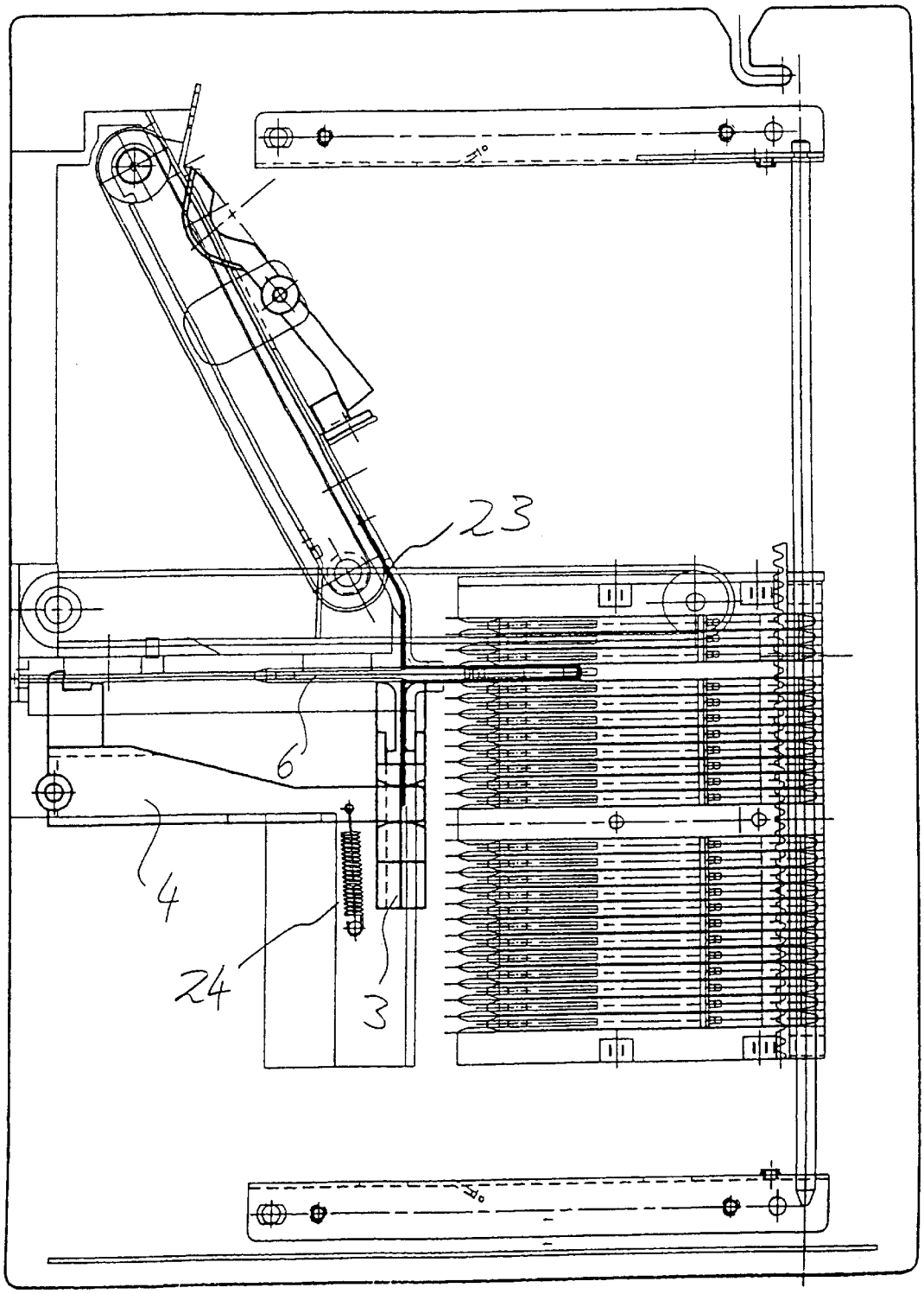
FIG. 4 the apparatus of FIG. 1 with a slider and bank note in the half inserted position.

FIG. 4 shows that the slider 6 is travelled back into the compartment 11 again. In this way, the lever 4 is no longer biased against the spring 24, but is pulled back by this into its rest position, whereby the guide element 3 is also brought back into the release position again. The bank note 23 can thus be reliably introduced into the compartment 11 via the slider 6.

Figure 5:
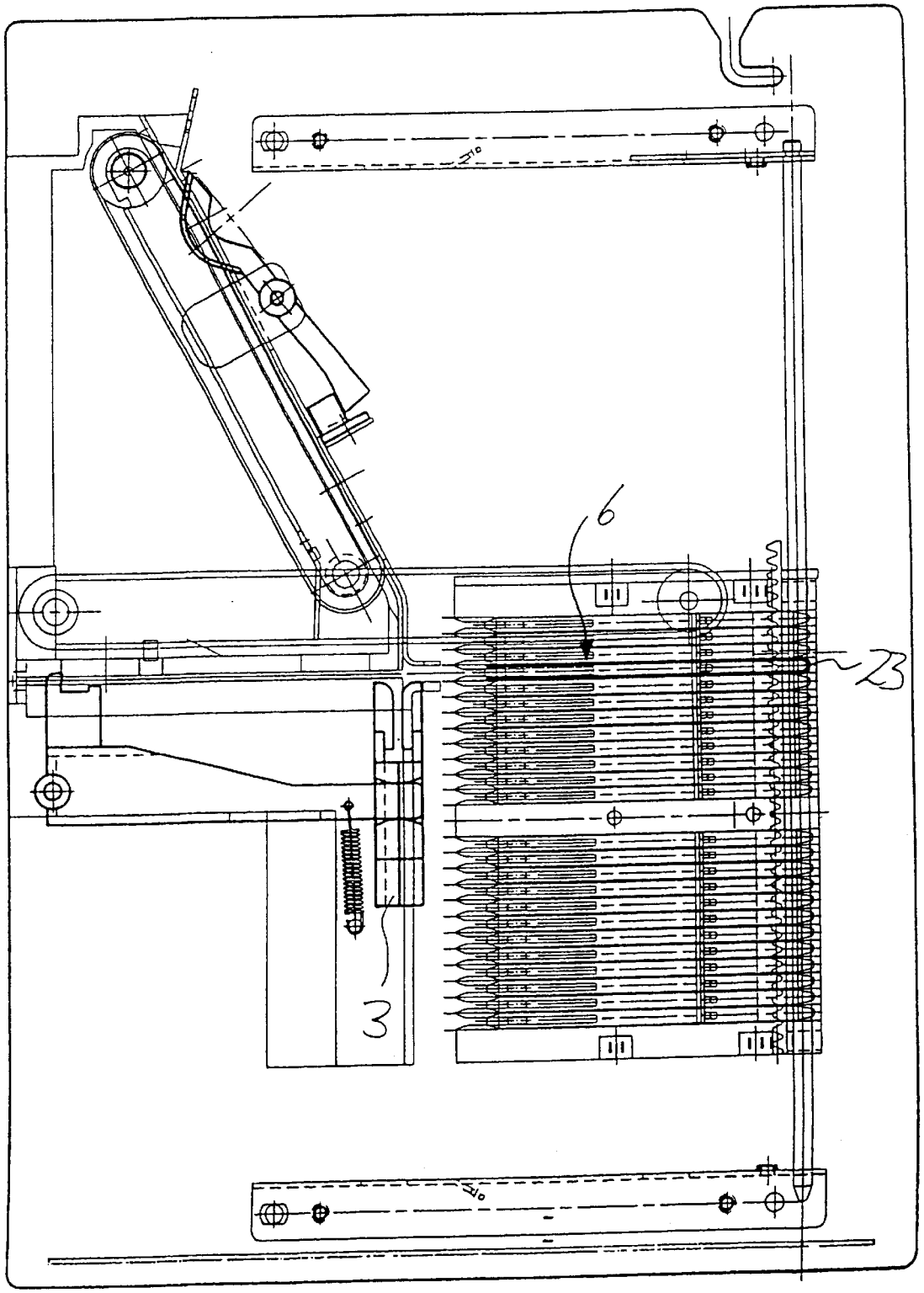
FIG. 5 the apparatus of FIG. 1 with a slider and banknote in a position inserted into the compartment.

FIG. 5 shows the slider 6 in its position fully inserted into the compartment 11 with the bank note 23.

To insert a further bank note 23 into another compartment, the compartment module 10 can be travelled via the rack-and-pinion drive 23 such that a free compartment 11 again lies at the insertion position for a bank note.

Figure 6:
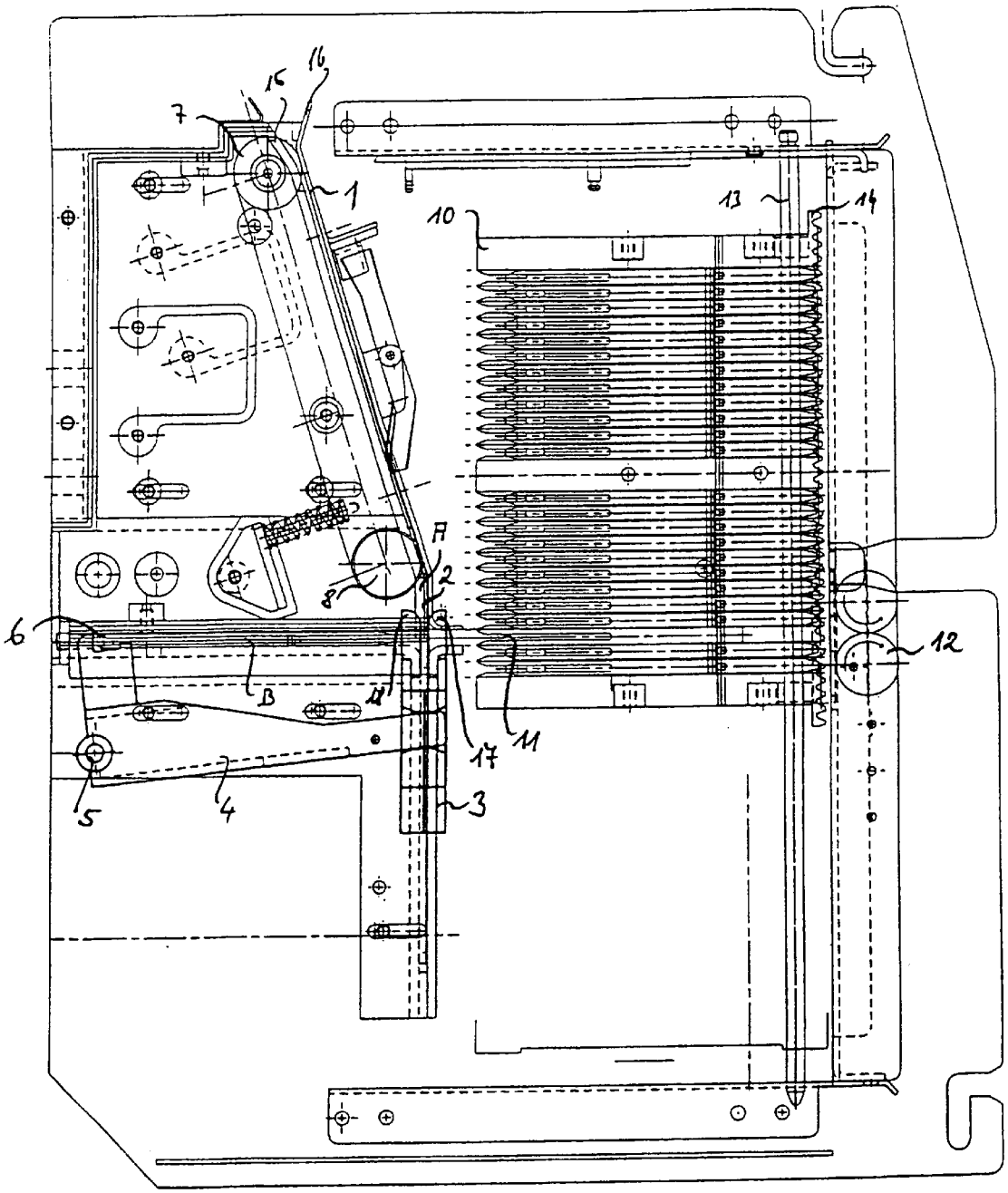
FIG. 6 an apparatus for the storage or dispensing of sheet-like material with a guide device in the blocked position in accordance with a second embodiment.

FIG. 6 shows a second embodiment of an apparatus for the storage and/or dispensing of bank notes 23 with the guide element 3 in accordance with the invention in the blocking position.

The compartment module 10, in turn, is guided vertically at the rod system 13 and is displaced in its position via the rack 14. Furthermore, the compartment module 10 is equipped with sword-like sliders 6 in its compartments. The banknotes to be stored can be inserted into the compartments by the respective slider while being folded in a loop-like fashion after the corresponding compartment 11 has been travelled into the central plane of the bank note to be stored by the rack-and-pinion drive 14, as described above.

A dog, which is also not further illustrated, is provided to move the respective slider 6 and can be travelled by a cogged belt drive. The respective slider 6 can thus be guided in the horizontal direction via the dog.

Motors are provided in each case, which are controlled by a central microprocessor, to control the drive rolls 7, 8 of the rack-and-pinion drive 14 and the cogged belt drive for the dog of the respective slider 6.

A bank note tester such as is known, for example, from DE 40 05 291 C2 can be provided in front of the conveyor device 1. As soon as the bank note has passed the bank note tester and reached the inlet of the conveyor device 1, it is taken up by the drive roll 7 and transported onwards between the guide metal sheets 15, 16. As soon as the front end of the bank note reaches the position A, it is detected by a light barrier not shown in any further detail, whereupon the drive rolls 7, 8 are driven under time control for so long until the centre of the bank note is located approximately opposite the compartment 11 of the compartment module 10. Previously, the slider 6 has been displaced by the dog not shown in any further detail out of the compartment 11 of the compartment module 10 into the waiting position B. In this position, the lever 4 pivoted around the pivot axis 5 is actuated in the counter clockwise direction by the slider 6 so that the guide element 3 is pushed vertically upwards. The guide element 3 here consists of two parallel guide metal sheets 3*a* and 3*b* between which the bank note to be transported is guided. In the position of the guide element 3 shown in FIG. 6, the bank note 23 to be transported is inserted by the guide metal sheet 16 directly into the opening 3*d* of the guide element 3 formed by the guide metal sheets 3*a* and 3*b* so that it is reliably prevented that the front end of the bank note is erroneously guided from the position A into the corresponding compartment 11 of the compartment battery 10 or backwards into the waiting position B.

Figure 7:
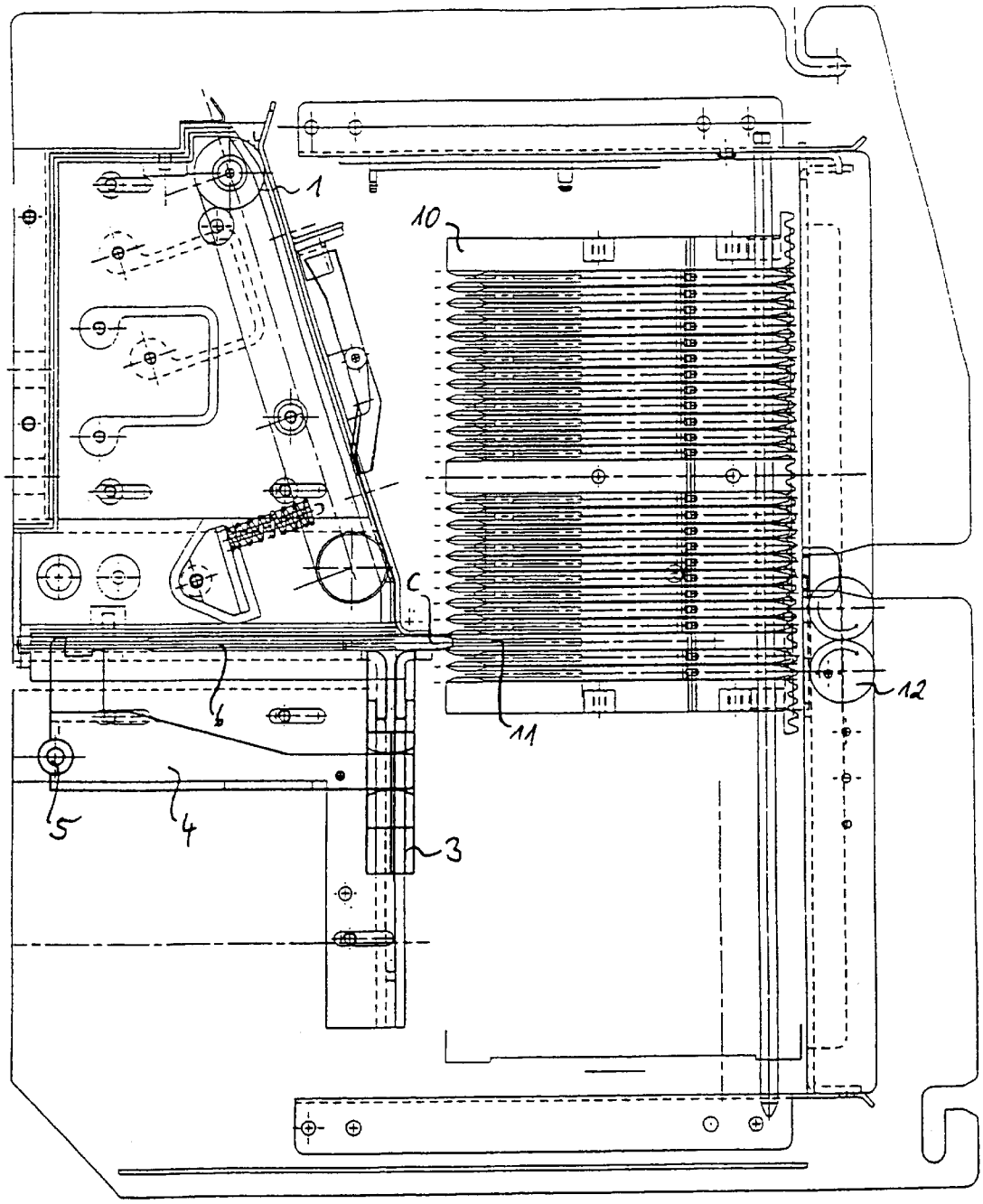
FIG. 7 the apparatus in accordance with FIG. 6 with a guide device in a release position.

FIG. 7 shows the apparatus for the storage and dispensing of bank notes in accordance with FIG. 1 with the guide element 3 in accordance with the invention in the release position. As soon as the bank note 23 has been travelled into a central position with respect to the corresponding compartment 11 of the compartment module 10, the slider 6 is travelled via the dog driven by a cogged belt drive into an inserted position in which the other sliders of the compartment module 10 are also located. The position C shown in FIG. 7 here shows an intermediate position between the waiting position B shown in FIG. 6 and the inserted position in the compartment 11. As soon as the slider 6 is moved out of the waiting position B, the lever 4 is released by the slider 6 and moves with the guide element 3 in the clockwise direction so that the compartment 11 has been released for the slider 6. When the slider 6 is moved into the inserted position in the compartment 11 of the compartment module 10, the bank note is thus inserted into the compartment 11 folded at the centre.

To dispense the bank note 23, the slider 6 is further displaced in the compartment 11 from the inserted position into a dispensing position so that the bank note can be taken up by a removing roll pair 12. The slider 6 here has a recess centrally so that the slider can move past to the right and left next to the removal rolls and the bank note 23 can thus be taken up by the removal roll pair 12 unhindered by the slider.

Figure 8A:
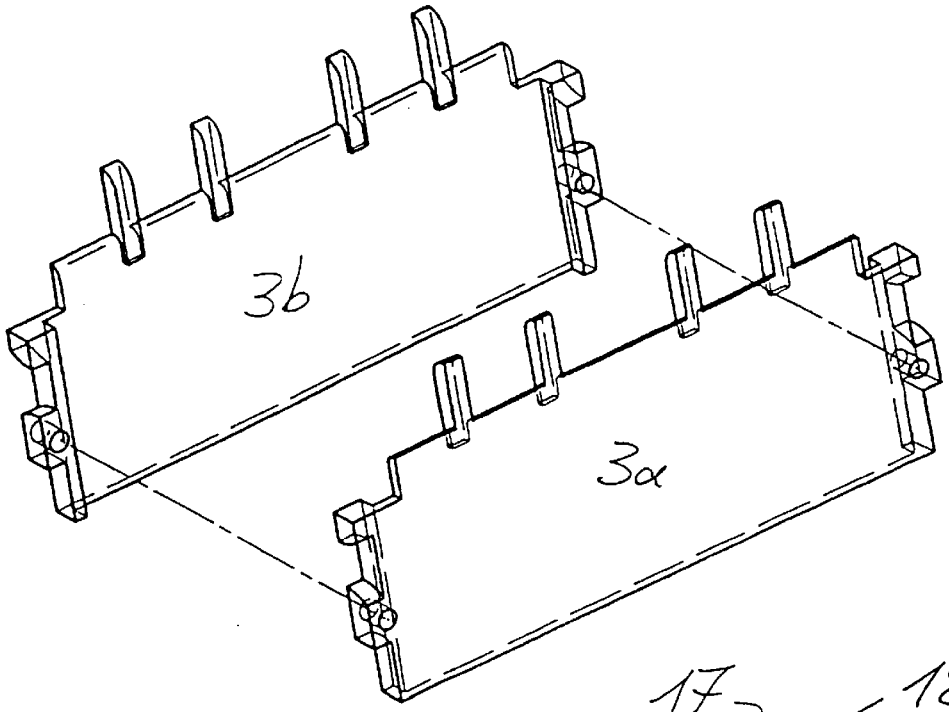
FIG. 8*a* the guide device in accordance with the invention in an exploded representation.
Figure 8B:
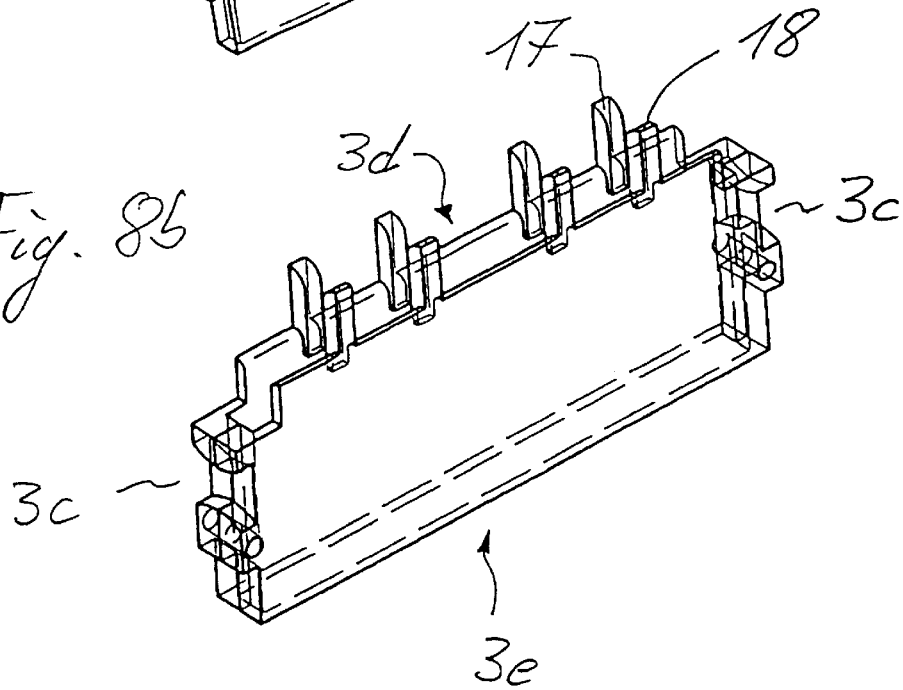
FIG. 8*b* the guide device in accordance with FIG. 8*a* in the assembled state.

The guide element 3 can be seen in an exploded view in FIG. 8*a*. The opposite guide metal sheets 3*a* and 3*b* are formed symmetrically to one another and have in the assembled state, as shown in FIG. 8*b*, fork-like tongues 17 and 18 which oppose one another in pairs at the upper end and which can reliably feed a bank note guided from above to the feed opening 3*d*; at the side, both guide metal sheets 3*a* and 3*b* have recesses 3*c* which serve the engagement of the previously described lever 4 for the movement of the guide element 3. At the lower side, the outlet opening 3*e* is shown as a dotted line in FIG. 8*b* at which an inserted bank note can again exit from the guide element 3.

Figure 8D:
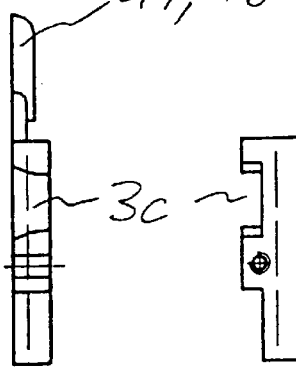
FIGS. 8*c* to 8*e* side views and a top view of a side element of the guide device in accordance with FIGS. 8*a* and 8*b*.
Figure 8C:
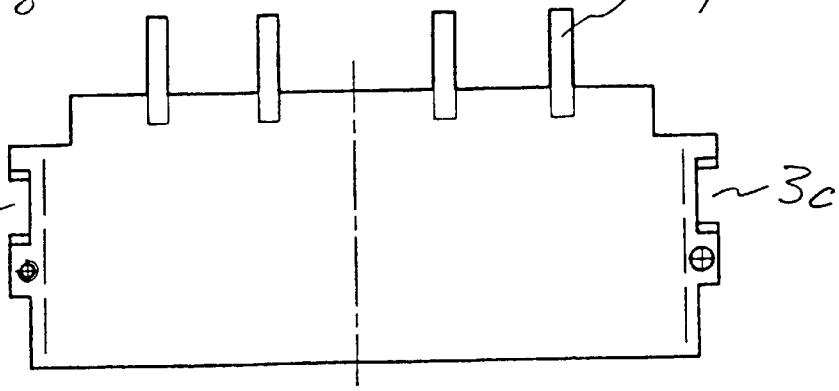
Figure 8E:
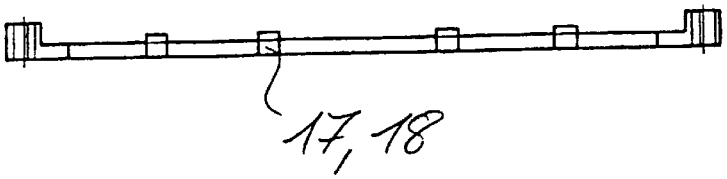

FIGS. 8*c* to 8*e* show side views and a plan view of one of the symmetrically formed guide metal sheets 3*a* or 3*b*.

The solution in accordance with the invention is further characterised in that a displaceably guided compartment module having compartments open at the end side and separated from one another by side walls is provided in guides of a housing, in that a slider can be moved in a passage in a longitudinally displaceable manner between a waiting position and an inserted position, with the slider—on travelling from the waiting position to the inserted position while folding a bank note fed by a conveyor device—inserts said bank note in a loop-like manner into a corresponding compartment of the compartment module, in that a blocking element is provided which cooperates with the slider such that the blocking element at least blocks the path from the conveyor device into the passage when the slider is located in the waiting position, and in that the blocking element at least releases the path from the conveyor device into the passage when the slider is moved into the corresponding compartment of the compartment module.

The apparatus in accordance with the invention is further characterised by the compartment module displaceably guided in a housing in whose compartments the bank notes are stored in loop-like form folded on themselves ordered according to their value. For their storage, the bank notes can be simply introduced into the compartments by a slider. To prevent a bank note fed from the conveyor device entering a compartment of the compartment module directly and without actuating the slider, the blocking element is provided in accordance with the invention. The control of the blocking element in accordance with the invention ensures that the bank note can first be positioned in flat form in front of the compartment module on its way from the conveyor device to a corresponding compartment of the compartment module before the slider travels into the compartment module.

It can be provided here that the blocking element is coupled to a lever and is biased by a spring in a position releasing the passage, with the lever being actuated by the slider when the waiting position is reached such that the blocking element is pushed into the position blocking the passage. In this way, a particularly simple mechanical control of the blocking element is possible.

In accordance with a further embodiment, it can be provided that the blocking element is displaceable by a controlled drive, with a detector being provided for the control which is actuated by the slider in the waiting position. A microprocessor can usually be provided for the control. As soon as the slider is detected in the waiting position by the detector, a signal is forwarded to the microprocessor which has the effect that the slider lifts the blocking element into its position blocking the passage. If, on the other hand, the slider is moved out of the waiting position, the detector detects the end position so that the blocking element releases the path to the corresponding compartment in the compartment module.

Another possibility consists of the detector detecting the transported bank note shortly before reaching the passage. Accordingly, the blocking element is travelled into the passage as soon as the detector element reports the reaching of the bank note to the microprocessor and then travels back to the releasing position again either in a time-controlled manner or after a corresponding position detection of the detector element.

The detector can, for example, consist of a light barrier or a corresponding end switch or contact switch.

In accordance with a further preferred embodiment, the control of the blocking element can also take place centrally by a microprocessor which controls the compartment module, the slider and the blocking element by controlled drives. The control can take place, for example, by stepper motors so that the microprocessor is aware of the exact positions of the compartment module, the slider and the blocking element at every time.

The blocking element can consist of two walls guided in parallel between which the bank note can be inserted and/or conveyed.

In accordance with a further embodiment, it can be provided that the conveyor device consists of cogged belts driven by roll pairs. The driven cogged belts can be arranged parallel next to one another, for example, and be guided via a metal sheet so that a bank note is transported between the metal sheet and the two belts.

In accordance with another embodiment, it can be provided that the slider is further displaceable from the inserted position into a dispensing position, with the bank note being taken up and further transported by a dispensing apparatus in the dispensing position. In this way, the apparatus in accordance with the invention can be used both for the storage and the dispensing of bank notes. The dispensing device preferably consists of a removal roll pair and cogged belts driven by roll pairs following on therefrom. The driven cogged belts are in particular to be provided when the dispensing shaft is not located directly behind the removal roll pair, but is further away with respect to the removal roll pair. In this way, the folded note can be transported between the driven cogged belts. Depending on the application, the dispensing and the insertion of the bank note can take place via the same shaft or, however, a separate dispensing shaft and a separate insertion shaft are provided.

In accordance with a further embodiment, it can be provided that the slider has a corresponding recess centrally so that the slider can travel past to the right and left of the removal rolls. In this way, the removal rolls can take up the note and pull it off the slider.

What is claimed is:

1. An apparatus for the storage and/or dispensing of sheet-like material, in particular bank notes (23), comprising:

(a) a compartment module (10) having a plurality of compartments (11);

(b) a slider (6) which can be traveled into and out of a compartment (11) so that a sheet-like material (23) lying in front of an opening **(11*a*) of the compartment (11) can be inserted into and/or dispensed from the compartment (11) while being folded; and (c) a guide device (3) which is displaceable between two positions, in the first position the sheet-like material (23) being able to be introduced into the guide device (3) and the opening (11*a*) of the compartment (11) being blocked, and in the second position the opening (11*a*) of the compartment (11) being free so that the sheet-like material (23) can be inserted into the compartment (11)**.

2. An apparatus in accordance with claim 1, wherein each compartment (11) has a slider (6).

3. An apparatus in accordance with claim 1, wherein a conveyor device (1) is provided for the feeding of the sheet-like material (23).

4. An apparatus in accordance with claim 1, wherein a lever (4) is provided which is coupled to the guide device (3) and the slider (6) such that the slider (6) in a position travelled out of the compartment (11) moves the lever (4) so that the guide element (3) is pushed into a position blocking the opening (11*a*) of the compartment (11), and in another position of the slider (6), the guide device (3) is brought into the releasing position by the lever (4).

5. An apparatus in accordance with claim 1, wherein the slider (6) can be displaced from the inserted position in a compartment (11) further into a dispensing position.

6. An apparatus in accordance with claim 1, wherein a dispensing device (12), in particular a roll pair, is arranged in the dispensing position of the sheet like material (23).

7. An apparatus in accordance with claim 1, wherein the slider (6) has a recess so that the slider (6) can be guided past the dispensing device.

8. An apparatus in accordance with claim 1, wherein said second position of said guide device (3) is located below said first position.

9. An apparatus for the storage and/or dispensing of sheet-like material, in particular bank notes (23), comprising:

(a) a compartment module (10) having a plurality of compartments (11);

(b) a slider (6) which can be traveled into and out of a compartment (11) so that a sheet-like material (23) lying in front of an opening (11*a*) of the compartment (11) can be inserted into and/or dispensed from the compartment (11) while being folded; and (c) a guide device (3) which is displaceable between two positions, in the first position the sheet-like material (23) being able to be introduced into the guide device (3) and the opening (11*a*) of the compartment (11) being blocked, and in the second position the opening (11*a*) of the compartment (11) being free so that the sheet-like material (23) can be inserted into the compartment (11), wherein a lever (4) is provided which is coupled to the guide device (3) and the slider (6) such that the slider (6) in a position traveled out of the compartment (11) moves the lever (4) so that the guide element (3) is pushed into a position blocking the opening (11*a*) of the compartment (11), and in another position of the slider (6), the guide device (3) is brought into the releasing position by the lever (4), and a spring (5) biases the lever (4) in a position in which the opening (11*a*) of the compartment (11) is released by the guide device (3).

10. An apparatus for the storage and/or dispensing of sheet-like material, in particular bank notes (23), comprising:

(a) a compartment module (10) having a plurality of compartments (11);

(b) a slider (6) which can be traveled into and out of a compartment (11) so that a sheet-like material (23) lying in front of an opening (11*a*) of the compartment (11) can be inserted into and/or dispensed from the compartment (11) while being folded; and (c) a guide device (3) which is displaceable between two positions, in the first position the sheet-like material (23) being able to be introduced into the guide device (3) and the opening (11*a*) of the compartment (11) being blocked, and in the second position the opening (11*a*) of the compartment (11) being free so that the sheet-like material (23) can be inserted into the compartment (11), wherein the compartment module (10) is displaceable.

11. A guide device for sheet-like material (23), in particular bank notes, comprising:

a) a first guide plane (3*a*);

b) a second guide plane (3*b*), which is opposite the first guide plane (3*a*) so that a guide gap is formed therebetween;

c) a feed aperture (3*d*) at one side of the first and second guide planes (3*a*, 3*b*); and d) at least one coupling element (3*c*) for the engagement of a movement apparatus for the guide device (3).

12. A guide device in accordance with claim 11, wherein at least one feed device (17, 18) is provided at the feed opening (3*d*) to guide the sheet-like material to the feed opening (3*d*).

13. A guide device in accordance with claim 11, wherein the feed device (17,18) represents an opening tapering in the direction of the feed opening (3*d*).

14. A guide device in accordance with claim 11, wherein the feed apparatus is formed by fork-like elements (17,18) opposite one another in pairs.

15. A guide device in accordance with claim 11, wherein the coupling elements are recesses (3*c*) at opposite sides of the first and second guide planes (3*a*,3*b*).

16. A use of the guide device in accordance with claim 11, in an apparatus for the storage and/or dispensing of sheet-like material, in particular bank notes.

17. A conveyor device for sheet-like material (23), in particular bank notes, comprising:

a) a first guide metal sheet (16); and b) a movable belt (20) which can be moved along the surface of the first guide metal sheet (16) so that the sheet-like material (23) can be transported between the first guide metal sheet (16) and the movable belt (20).

18. A conveyor device in accordance with claim 17, wherein a second guide metal sheet (15) is arranged opposite the first guide metal sheet (16).

19. A conveyor device in accordance with claim 17, wherein a guide element (22) is provided to generate a pressure force between a guided sheet-like material (23) and a moveable belt (20).

20. A conveyor device in accordance with claim 17, wherein a block pulley (8), over which the movable belt (20) is guided, can be pivoted such that a pressure force can be generated between the movable belt (20) and a guide metal sheet (15,16).

* * * * *